United States Patent [19]

Swearengen et al.

[11] Patent Number: 4,601,123

[45] Date of Patent: Jul. 22, 1986

[54] CONVERTIBLE SHOTGUN

[75] Inventors: Thomas F. Swearengen, Burton, S.C.; Walter J. Makauskas, Prospect, Conn.

[73] Assignee: O. F. Mossberg & Sons, Inc., North Haven, Conn.

[21] Appl. No.: 569,748

[22] Filed: Jan. 10, 1984

[51] Int. Cl.[4] ..... F41C 7/08; F41C 17/08; F41C 23/00

[52] U.S. Cl. ..... 42/72; 42/71 R; 42/70 R; 42/74; 42/74.01; 42/70.01

[58] Field of Search ..... 42/71 R, 75 A, 75 C, 42/72, 1 R, 70 R

[56] References Cited

U.S. PATENT DOCUMENTS

| | | | |
|---|---|---|---|
| 1,376,165 | 4/1921 | Rosebush | 42/70 R |
| 3,222,809 | 12/1965 | Bryan | 42/70 R |
| 3,488,488 | 1/1970 | Crouch | 42/75 A |
| 3,512,290 | 5/1970 | La Violette, Jr. et al. | 42/75 A |
| 3,611,607 | 10/1971 | Donnell | 42/72 |
| 3,685,194 | 8/1972 | Coon | 42/72 |
| 3,798,819 | 3/1974 | Hillberg | 42/71 R |
| 4,445,292 | 5/1984 | Martin | 42/70 R |

OTHER PUBLICATIONS

"Gun Control Act Questions and Answers", ATF Publication 650, (Rev. 7-72) Dept. of Treasury, Bureau of Alcohol, Tobacco, & Firearms.

*Primary Examiner*—Charles T. Jordan
*Assistant Examiner*—Ted L. Parr
*Attorney, Agent, or Firm*—McCormick, Paulding & Huber

[57] ABSTRACT

A sporting shotgun from which the stock and forearm have been removed is partially encapsulated within a clamshell housing assembly which includes a stock and pistol grip and which substantially alters the appearance of the shotgun. Projections within the housing assembly block a safety member on the gun in an inoperative position. A recoil beam attached to the receiver of the shotgun and contained with the butt end of the stock functions as a recoil absorber and also cooperates with a cup-shaped butt plate to retain the butt end portion of the housing in assembly. The trigger of the shotgun is encapsulated within the stock and connected by a trigger connecting assembly to an auxiliary trigger associated with the pistol grip.

17 Claims, 14 Drawing Figures

CONVERTIBLE SHOTGUN

BACKGROUND OF THE INVENTION

This invention relates in general to firearms and deals more particularly with a convertible firearm or shotgun and a retrofit assembly for converting an existing gun of one type to a gun of another type.

The escalating incidence of suburban crime has created a demand for improved home security weapons. The military combat or battle-type shotgun, widely used by law enforcement agencies, is gaining popularity as a basic home security weapon. It is generally recognized that a shotgun is more ideally suited than a handgun for use as a home defense weapon, because of the high probability of a first shot hit, even in the hands of a relatively inexperienced person. The devastating effect of a shotgun at close range is well known. Consequently, an intruder is not likely to attack when confronted with a shotgun. Further, if it should be necessary to fire a shotgun in defense within a building, it is unlikely that the shotgun charge would retain sufficient velocity to kill or seriously wound an innocent person outside of the building, after passing through a building wall.

Heretofore, various attachments and accessories have been provided which enable both law enforcements agencies and private citizens to convert a sporting type shotgun into a shotgun of the combat or military type. However, the trigger and trigger guard on most sporting shotguns is located near the stock end of the receiver which presents a conversion problem. Consequently, most sporting gun conversions are made by removing the fixed stock and replacing it with a folding stock or pistol grip. Where a folding stock is used, it is usually only slightly shorter than the fixed stock which it replaces. Storing such a weapon in a compact motor vehicle, such as now commonly used by many law enforcement agencies, can pose a serious problem. Generally, the weapon must be stored with its stock folded, which is not particularly desirable, since it may cause delay in bringing the weapon into play in an emergency situation.

Another approach employed to convert a sporting type shotgun into a shotgun of military or combat type is shown in U.S. Pat. No. 3,512,290 to La Violette, Jr., et al, for FIREARM HOUSING ASSEMBLY HAVING THREE SECTIONS AND AN INTERLOCKING CENTRAL COUPLING MARKER THEREFORE, issued May 19, 1970 and assigned to The High Standard Manufacturing Corporation. La Violette, Jr., et al employs a retrofit housing assembly to encapsulate a modified sporting shotgun to permanently convert the shotgun to a combat or military type. However, the modifications required to enable encapsulation render the gun wholly unsuitable for further use as a sporting gun.

Accordingly, it is the general aim of the present invention to provide a convertible shotgun which may be readily converted to either a sporting type shotgun or a military or battle type shotgun. It is a further aim of the present invention to provide a retrofit housing assembly to partially encapsulate an existing shotgun and thereby convert a shotgun of a sporting type to a shotgun of a substantially different type without requiring modification of the existing basic shotgun and without altering its operational characteristics. It is a still further aim of the invention to provide a retrofit assembly which may be readily assembled with or removed from an existing sporting shotgun without risk of inadvertently disabling the gun firing mechanism.

SUMMARY OF THE INVENTION

In accordance with the present invention, a convertible firearm comprises a basic firearm and a retrofit assembly. The basic firearm has a receiver, a barrel projecting forwardly from the receiver, firing means contained within the receiver and including a trigger extending from the receiver for discharging the basic firearm, and safety means for disabling the firing means and including a safety member supported on the receiver and normally movable between a safe position wherein the firing means is disabled and an off position wherein the firing means is operable in response to operation of the trigger. The retrofit assembly includes a housing which has a plurality of housing sections for cooperating with each other and with the basic firearm in assembly to envelop at least a portion of the basic firearm, disabling means associated with the housing for retaining the safety member in its off position, and means for releasably securing the housing sections in assembly with each other. The disabling means prevents assembly of the retrofit housing with the basic shotgun when the safety member is in its safe position.

DETAILED DESCRIPTION OF PREFERRED EMBODIMENT

Figure 1:
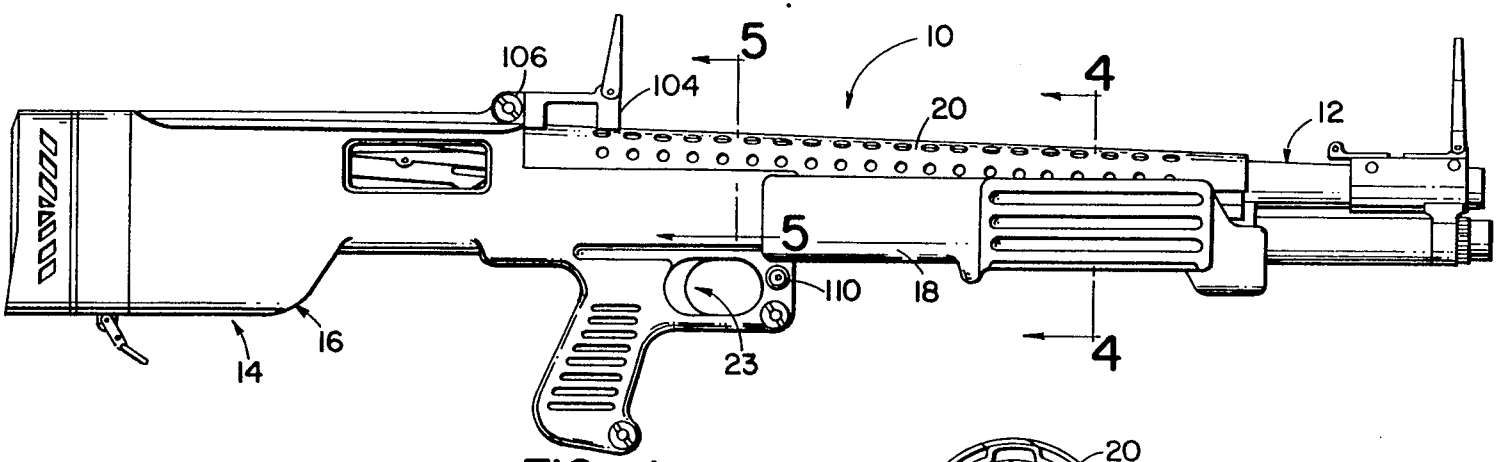
FIG. 1 is a side elevational view of a convertible firearm embodying the present invention.

Turning now to the drawings, a convertible firearm or shotgun embodying the present invention is shown in FIG. 1 and indicated generally by the reference numeral 10. The illustrated shotgun 10 essentially comprises a basic sporting shotgun, indicated generally at 12 and best shown in FIG. 6, from which the stock and forearm have been removed, and a retrofit assembly indicated generally at 14 assembled with the basic shotgun 12 to form the convertible combat or military type shotgun 10. The retrofit assembly 14 essentially comprises a housing assembly, indicated generally at 16, and a forearm 18, which replaces the one removed from the sporting gun. The retrofit assembly further includes a heat shield 20, a recoil beam designated generally by the numeral 21 in FIG. 6, and an auxiliary trigger assembly, indicated generally at 23. The housing assembly 16, forearm 18 and heat shield 20 cooperate in assembly with the basic sporting shotgun 12 to encapsulate a portion of the gun whereby to convert it from a shotgun of sporting length to a combat or military type shotgun of somewhat shorter length. The conversion is made without altering the operational characteristics of the gun or requiring any modification of the gun other than the simple removal of parts, which may be readily reassembled with the gun to return the gun to its original sporting form after the retrofit assembly has been removed from it.

Figure 6:
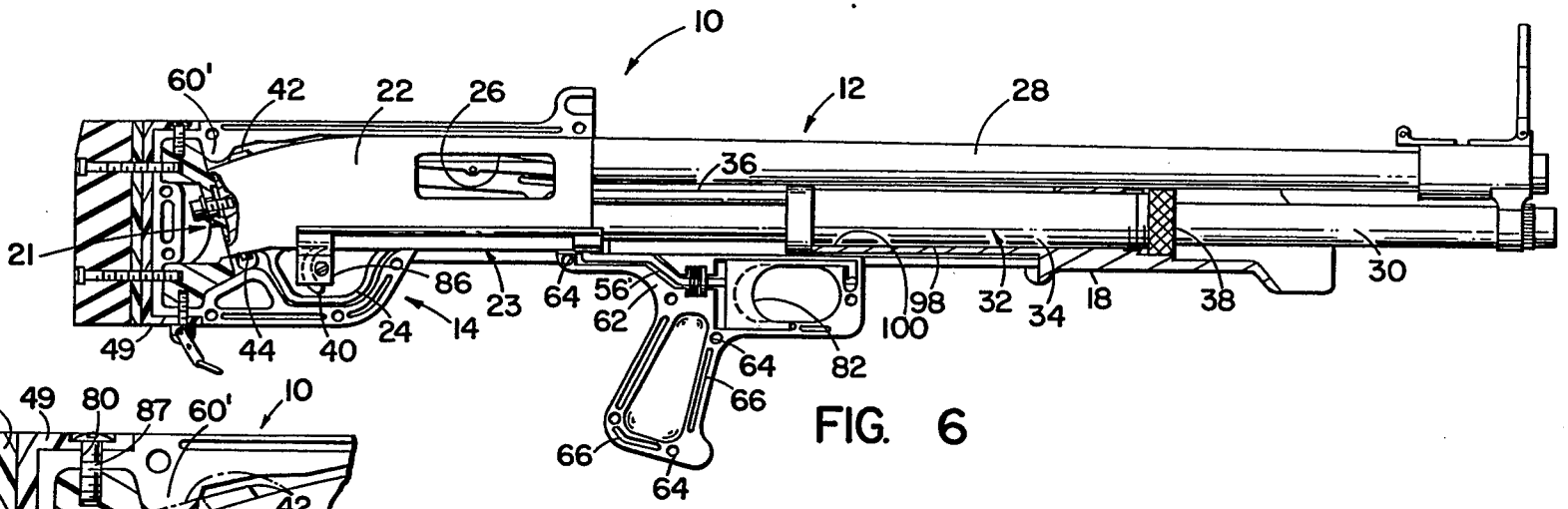
FIG. 6 is a longitudinal sectional view through the firearm of FIG. 1, shown with the heat shield removed.

The basic shotgun 12, best shown in FIG. 6, has a receiver 22 which includes an integral trigger guard 24 near its rear or stock end. A rectangular ejection port 26 opens through the right-hand wall of the receiver and a rectangular loading opening is formed in the bottom wall of the receiver, forward of the trigger guard 24, but not shown, through which shells are loaded into the gun 12 in a manner well known in the art. A rearwardly opening shaped recess 27, formed in the rear wall of the receiver, and best shown in FIG. 14, normally receives a complementary projection on the forward end of the stock to retain the stock in a proper position of alignment with the receiver. A barrel 28 projects forwardly from the receiver and may be provided in various lengths and choke combinations.

The gun 12 further includes a magazine tube 30, which extends forwardly from the receiver below and in parallel relation to the barrel. An action slide assembly, indicated generally at 32 in FIG. 6, includes a slide tube 34, slidably supported on the magazine tube 30, and a pair of action bars 36, 36 (one shown) which extend rearwardly from the slide tube at opposite sides of the magazine tube and into the receiver 22, for moving a bolt contained within the receiver to and from battery position. The forward end of the slide tube 32 is threaded to receive an action slide tube nut 38 which normally retains a forearm of the sporting shotgun 12 in fixed position on the slide tube to move with it. A conventional firing mechanism contained within the receiver 22 includes a shotgun trigger 40, which is pivotally supported within the receiver and exposed within the trigger guard 24.

Figure 14:
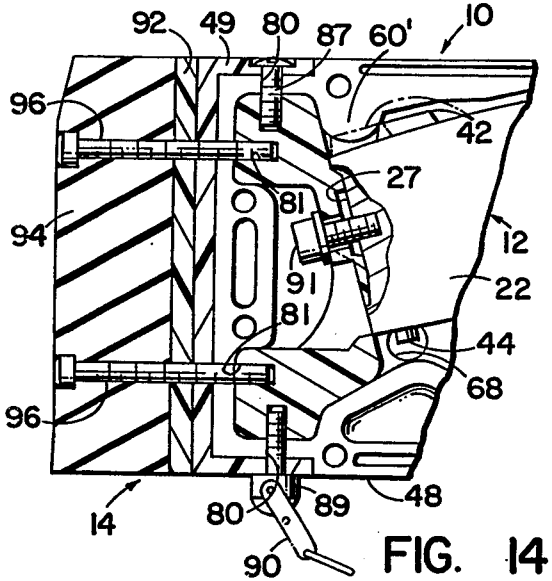
FIG. 14 is similar to FIG. 6 but shows a somewhat enlarged fragmentary portion of the firearm as it appears in FIG. 6.
Figure 7:
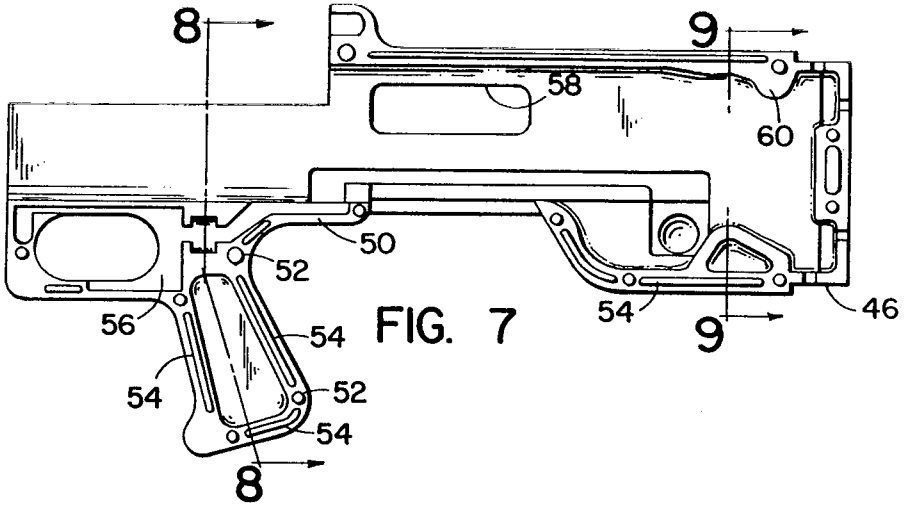
FIG. 7 is a side elevational view of the right-hand section of the housing as viewed from its inner side.

The gun 12 has a conventional safety mechanism for disabling the firing mechanism to prevent accidental discharge and includes a safety button 42, shown in FIG. 6 and 14, which is slidably supported on the upper portion of the receiver, immediately forward of its stock end, for movement between a safe position indicated by broken lines in FIG. 14, wherein the firing mechanism is disabled, and an off or full line position, wherein the firing mechanism is operable in response to operation of the shotgun trigger 40.

When the bolt is in battery position the slide tube 34 and a forearm attached to it are normally locked in forward position, as shown in FIG. 6. To enable a shell to be ejected from the shotgun 12 without firing it, a forearm release mechanism is provided which includes a forearm release button 44. The release button projects from the bottom wall of the receiver 22 near the rear of the trigger guard 24, substantially as shown in FIG. 6.

The invention may be practiced with various shotguns of sporting length, however, the illustrated shotgun 12 comprises a MOSSBERG 500 slide action shotgun manufactured and marketed by O. F. Mossberg & Sons, Inc., North Haven, Conn. 06473.

Considering now the retrofit assembly 14 in further detail, the hollow clam shell housing assembly 16 is preferably molded from strong, impact-resistant thermoplastic material and includes a pair of mating half-sections 46 and 48 of opposite hand and a cup-shaped butt plate 49. The housing sections cooperate in assembly to encapsulate the receiver 22 and contain portions of the barrel 12, magazine tube 30 and action slide assembly 32.

Figure 8:
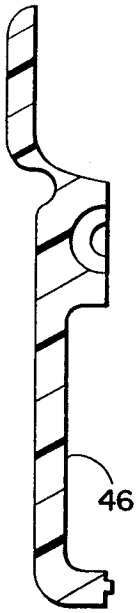
FIG. 8 is a somewhat enlarged sectional view taken generally along the line 8—8 of FIG. 7.

Referring to FIG. 8, the right-hand housing section 46 is cored to receive and complement a portion of right-hand side of the shotgun 12 and has a parting surface 50 adapted for mating engagement with an associated parting surface of the left-hand section 48. A plurality of circular bosses 52, 52 and elongated ribs 54, 54 project from the surface 50, substantially as shown. A recess 56 is formed in the wall of the section 46 to receive an associated portion of the auxiliary trigger assembly 23, as will be hereinafter further discussed. A rectangular ejection port 58 opens through the wall of the housing section 46 for registry with the receiver ejection port 26. A molded projection 60 on the upper portion of the housing section 46 extends into the cavity defined by the housing section for a purpose which will be hereinafter explained.

Figure 2:
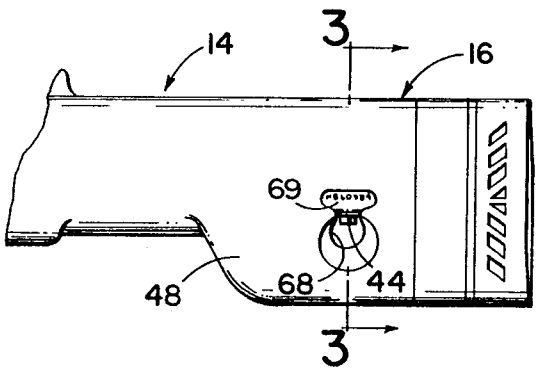
FIG. 2 is a fragmentary side elevational view of the opposite side of the firearm shown in FIG. 1.

The left-hand housing section 48 is similar in most respects to the right-hand section 46 and has a parting surface 62 for mating engagement with the parting surface 50. Circular holes 64, 64 and elongated recesses 66, 66, formed in the section 48, receive and complement the bosses 52, 52 and ribs 54, 54 when the two housing sections are joined in assembly. Preferably and as shown, the left-hand section 48 also has a projection 60'. The left-hand section also includes a recess 56' for receiving an associated portion of the auxiliary trigger assembly 23. An opening 68 is formed in the left-hand section 48 for registry with the serial number of the gun, which, in the present instance, is imprinted on the left side of the receiver 22 immediately above the forearm release button 44, as best shown in FIG. 2, where the serial number is indicated at 69.

Figure 12:
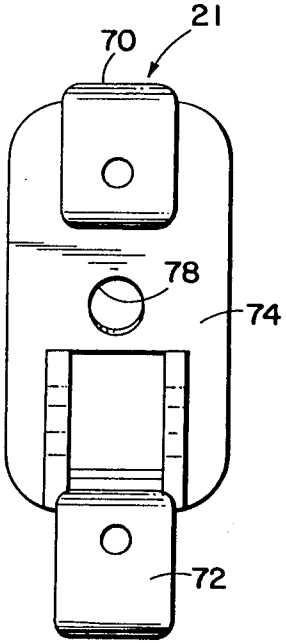
FIG. 12 is a rear elevational view of the recoil beam.
Figure 11:
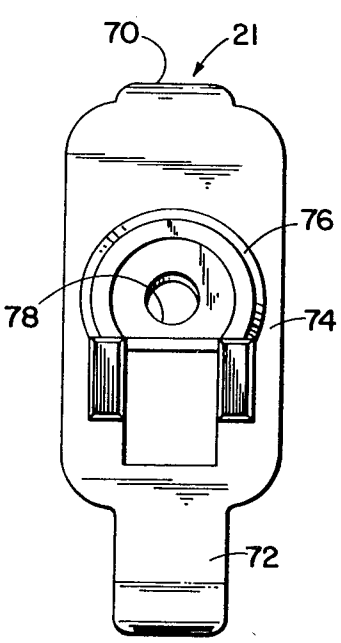
FIG. 11 is a front elevational view of the recoil beam.
Figure 10:
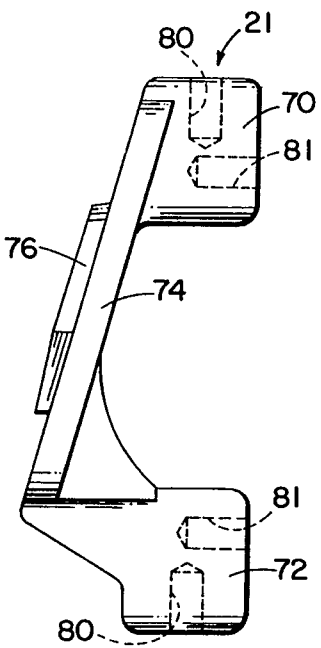
FIG. 10 is a somewhat enlarged side elevational view of the recoil beam.
Figure 9:
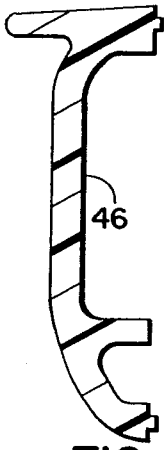
FIG. 9 is a somewhat enlarged sectional view taken along the line 9—9 of FIG. 7.

The recoil beam 21, best shown in FIGS. 10–12 serves to absorb recoil energy when the gun is fired and cooperates with the butt plate 49 to retain the housing sections 46 and 48 in assembly, as will be hereinafter further discussed. Essentially it comprises a unitary structure, preferably molded from durable resilient plastic material, and includes upper and lower end portions indicated at 70 and 72, respectively, and connected by a vertically inclined integral beam portion 74, which extends between the upper and lower end portions. A shaped key 76, best shown in FIG. 11, projects forwardly from the beam portion 74 and is adapted to be received within and complement the shaped recess 27 in the rear end wall of the receiver 22. A central aperture 78 in the beam portion 74 receives a fastener which secures the recoil beam 21 to the receiver 22. The enlarged upper and lower end portions 70 and 72 are adapted to be received within complementary recesses formed in the housing sections 46 and 48 to maintain the beam portion in spaced relation to the housing assembly 14. Blind holes 80, 80 and 81, 81 are provided in the upper and lower end portions 70, 72 to receive threaded or self-tapping fasteners, or if desired, may be provided with ultrasonically retained fastener inserts.

Figure 13:
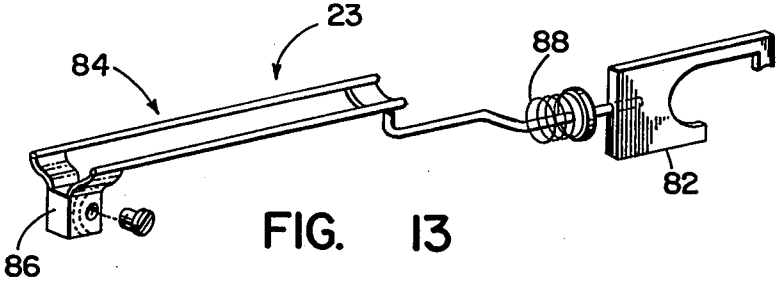
FIG. 13 is a perspective view of the auxiliary trigger assembly.

Referring now to FIG. 13, the auxiliary trigger assembly indicated generally by the numeral 23 essentially comprises an auxiliary trigger 82 and a trigger bar connecting assembly, indicated generally at 84, which carries a trigger connecting member 86 and an auxiliary trigger spring 88. The connecting bar assembly 84 is threadably connected with the auxiliary trigger 82 to permit some adjustment of the auxiliary trigger 82 relative to the trigger connecting bar and the trigger shotgun trigger 40.

Before encapsulating the receiver 22 within the clamshell housing assembly 14, the recoil beam 21, is secured to the stock end of the receiver 22 by a fastener 91, substantially as shown. The auxiliary trigger 82 and trigger connecting bar assembly 84, is clamped to the shotgun trigger 40 by the trigger connecting member 86.

It is essential that the safety button 42 be in its off or full line position of FIG. 14 to enable assembly of the housing sections 46 and 48 with the shotgun 12. If the safety button 42 is in its safe or broken line position of FIG. 14, interference between the safety button 42 and the projections 60 and 60' effectively prevents assembly of the housing sections with the shotgun 12.

When the two housing sections are brought together in mating engagement, the recoil beam upper and lower portions 70 and 72 are contained within complementary recesses in the rear end of the housing sections. The trigger guard 24 is also contained within a complementary recess in the housing assembly. The auxiliary trigger 82, trigger connecting bar assembly 84 and auxiliary trigger spring 88 are contained within associated portions of the recesses 56, 56'.

The housing sections are held in assembly by the cupshaped butt plate 49 which is received on and generally complements the butt end of the assembled housing sections. The housing sections are secured in assembly by suitable fasteners. One fastener 87 extends downwardly through the upper portion of the butt plate 49 and is threadably engaged in the hole 80 formed in the recoil beam upper portion 70. Another fastener 89, which carries a sling swivel 90, extends upwardly through a lower portion of the butt plate 49 and threadably engages the recoil beam lower portion 72. A spacer 92 and recoil pad 94 are secured to the butt end of the housing 14 by fasteners 96, 96 which threadably engage the recoil beam 21 within the holes 81, 81. In assembly, the two housing half sections 46 and 48 cooperate to define a loading opening below the receiver 22 and in registry with the loading opening in the lower side of the receiver 22.

The forearm 18 is also preferably made from a strong, impact resistant engineering type thermoplastic material and includes an integral tubular part 98 which has a cylindrical bore 100 for receiving the tubular portion 34 therethrough. The forearm 18 is releasably secured to the action slide assembly 32 by the action slide tube nut 38.

Figure 4:
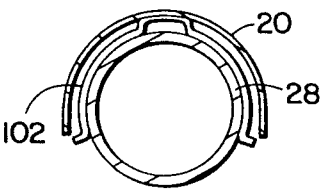
FIG. 4 is a sectional view through the barrel and heat shield taken along the line 4—4 of FIG. 1.
Figure 3:
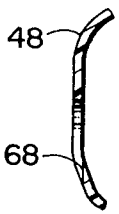
FIG. 3 is a sectional view through the left hand section of the housing taken along the line 3—3 of FIG. 2.
Figure 5:
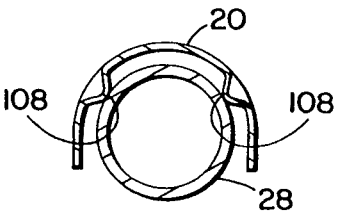
FIG. 5 is a sectional view through the barrel and heat shield taken along the line 5—5 of FIG. 1.

At its forward end, the perforated heat shield 20 is releasably secured to the barrel 28 by a spring clip 102, shown in FIG. 4, which also maintains the shield in spaced relation to the barrel. The heat shield is or may be further secured at its rear end by a rear sight 104 which is, in turn, secured to the housing by an associated fastener 106. Indentations 108, 108, in the heat shield further maintain the shield in spaced relation to the barrel 28, as shown in FIG. 5.

Since the safety button 42 is disabled, an auxiliary safety 110, which may comprise a safety button or lever, is provided at the forward end of the auxiliary trigger guard. This auxiliary safety is arranged to cooperate with a forwardly projecting portion of the auxiliary trigger for disabling the auxiliary trigger, in a manner well known in the art, so that the gun 10 cannot be fired, when the safety 110 is moved from an off position to a safe position.

If, after several shells have been fired in rapid succession it becomes necessary to immediately reload, the gun 10 is inverted to bring the loading opening into loading position. The heat shield permits immediate reloading after firing without risk of burn injury from contact with the hot barrel.

Since the housing assembly cannot be assembled with the gun 12 when the safety button 42 is in its safe position, the risk of improper assembly is eliminated. The converted battle shotgun 10 cannot be inadvertently assembled in an inoperative condition. The gun 10 may be readily reconverted to its sporting form by simply removing the retrofit assembly and replacing the gun stock and forearm originally provided with the gun 12.

We claim:

1. A convertible firearm comprising a basic firearm and a retrofit assembly, the basic firearm having a receiver, a barrel projecting forwardly from the receiver, firing means contained within the receiver and including a firearm trigger extending from the receiver and safety means for disabling the firing means and including a first safety member supported on the receiver and normally movable relative to the receiver between a safe position wherein the firing means is disabled and an off position wherein the firing means is operable to discharge the firearm, said retrofit assembly including a housing assembly having a plurality of housing sections cooperating in assembly with each other and with the basic firearm and enveloping at least a portion of the basic firearm, means for releasably securing said housing sections in assembly, and disabling means associated with the housing assembly for retaining the safety member in its off position.

2. A convertible firearm as set forth in claim 1 wherein said disabling means comprises an integral part of said housing assembly.

3. A convertible firearm as set forth in claim 2 wherein said part comprises a projection on at least one of said housing sections disposed in blocking relation to said safety member.

4. A convertible firearm as set forth in claim 3 wherein each of said housing sections has a projection thereon.

5. A convertible firearm as set forth in claim 1 wherein said housing assembly defines a stock having a butt end and said retrofit assembly includes means for absorbing recoil including a recoil beam disposed within said butt end and engaged with the rear end of the receiver.

6. A convertible firearm as set forth in claim 5 wherein said recoil absorbing means comprises said means for releasably securing said housing sections.

7. A convertible firearm as set forth in claim 6 wherein said means for releasably securing said housing sections further includes a cup-shaped butt member receiving and complementing an associated portion of said butt end and a fastener extending through said butt member and said butt end and engaging said recoil beam.

8. A convertible firearm as set forth in claim 5 wherein said recoil beam comprises a unitary resilient structural member having upper and lower end portions engaged with said housing assembly and an integral beam portion extending between said end portions and engaged with and fastened to the rear end of said receiver and maintaining said rear end in spaced relation to said butt end.

9. A convertible firearm as set forth in claim 1 wherein said housing assembly has a stock portion and a pistol grip portion forward of the stock portion and the receiver includes a trigger guard associated with the firearm trigger and contained within said stock portion.

10. A retrofit assembly for a basic firearm having a receiver, a barrel projecting from the receiver, firing means contained within the receiver and including a firearm trigger extending from the receiver for operating the firing means to discharge the basic firearm, and a safety means for disabling the firing means and including a safety member supported on the receiver for movement between a safe position wherein the firing means is disabled and an off position wherein the firing means is operable to discharge the firearm, said retrofit assembly including a housing means having a plurality of housing sections for cooperating in assembly with each other and with the basic firearm to receive and envelop at least a portion of the basic firearm, means for releasably securing said housing sections in assembly, means for preventing assembly of said housing sections with the basic firearm when the safety member is in its safe position, and means for retaining the safety member in its off position when the housing sections are assembled with each other and with the basic firearm.

11. A retrofit assembly for a basic firearm as set forth in claim 10 wherein said means for preventing assembly comprises said means for retaining the safety member.

12. A retrofit assembly for a basic firearm as set forth in claim 11 wherein said means for preventing assembly comprises a projection on at least one of said housing sections.

13. A retrofit assembly for a basic firearm as set forth in claim 12 wherein said means for preventing assembly comprises a projection on each of said housing sections.

14. A retrofit assembly for a basic firearm as set forth in claim 10 wherein said housing means defines a stock having a butt end and said retrofit assembly includes means for absorbing recoil when the basic firearm is fired and including a recoil beam having upper and lower end portions engaging said housing assembly and a beam portion extending between said upper and lower end portions in spaced relation to said housing assembly for attachment to the rear end portion of the receiver for maintaining said rear end portion in spaced relation to said butt end.

15. A retrofit assembly for a basic firearm as set forth in claim 14 wherein said recoil beam comprises said releasably securing means.

16. A retrofit assembly for a basic firearm as set forth in claim 15 wherein said securing means further comprises a butt plate defining a cup-shaped recess receiving and generally complementing an associated portion of said butt end and a fastener extending through said butt plate and said butt end and engaging said recoil beam.

17. A retrofit assembly for a basic firearm as set forth in claim 10 including a heat shield and means for releasably securing said heat shield to the barrel in spaced relation thereto.

* * * * *